United States Patent [19]

Toledo

[11] Patent Number: 5,016,927

[45] Date of Patent: May 21, 1991

[54] DOGGING DEVICE FOR PANIC EXIT DEVICE

[75] Inventor: George Toledo, Fall Brook, Calif.

[73] Assignee: Thomas Industries Inc., Los Angeles, Calif.

[21] Appl. No.: 594,284

[22] Filed: Oct. 9, 1990

[51] Int. Cl.[5] ..... E05C 3/08

[52] U.S. Cl. ..... 292/92; 292/210; 292/336.3

[58] Field of Search ..... 292/21, 63, 62, 67, 292/69, 150, 153, 92, 207, 210, 336.3

[56] References Cited

U.S. PATENT DOCUMENTS

| | | | |
|---|---|---|---|
| 1,126,969 | 2/1915 | Foerster | 292/114 |
| 3,663,047 | 5/1972 | Zawadzki | 292/92 |
| 4,968,070 | 11/1990 | Choi | 292/92 |

*Primary Examiner*—Richard E. Moore

[57] ABSTRACT

A dogging device for a door panic exit device which provides a tongue portion which releasably engages a ledge portion of an inwardly projecting push bar to lock the push bar in an inward position with respect to the door. The tongue portion is mounted for axial movement and limited rotational movement with respect to a housing of the panic exit device. In an undogged condition the ledge portion moves inward with the push bar and abuts and deflects the tongue portion harmlessly inwardly without any engagement. By axially translating the tongue portion into the housing the tongue portion clears the ledge portion and springs into a position outwardly of a trailing side of the ledge portion whereupon release of the actuating button translates, by a spring bias, the tongue portion back axially toward its original position, which results in the tongue portion being positioned abutting the trailing side of the ledge. A lug abutting the housing limits the rotational movement of the tongue portion so that retraction of the ledge portion, and thus the push bar, is prohibited.

20 Claims, 2 Drawing Sheets

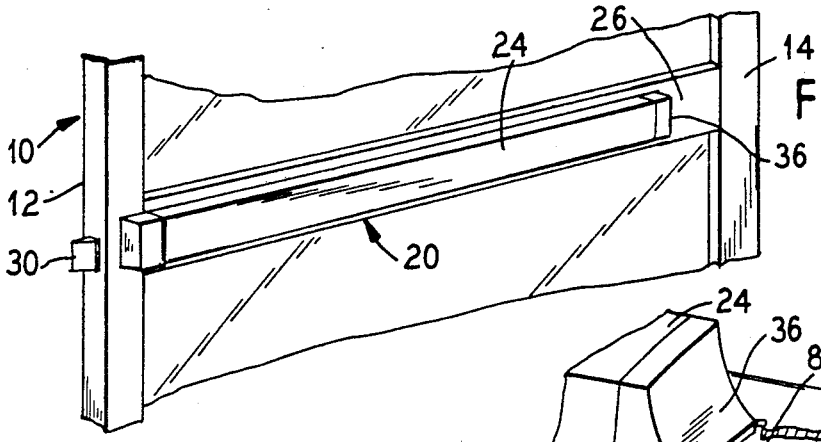
FIG. 1
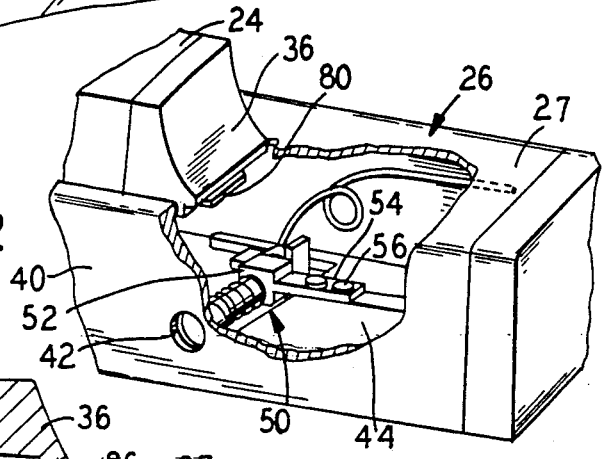
FIG. 2
FIG. 3
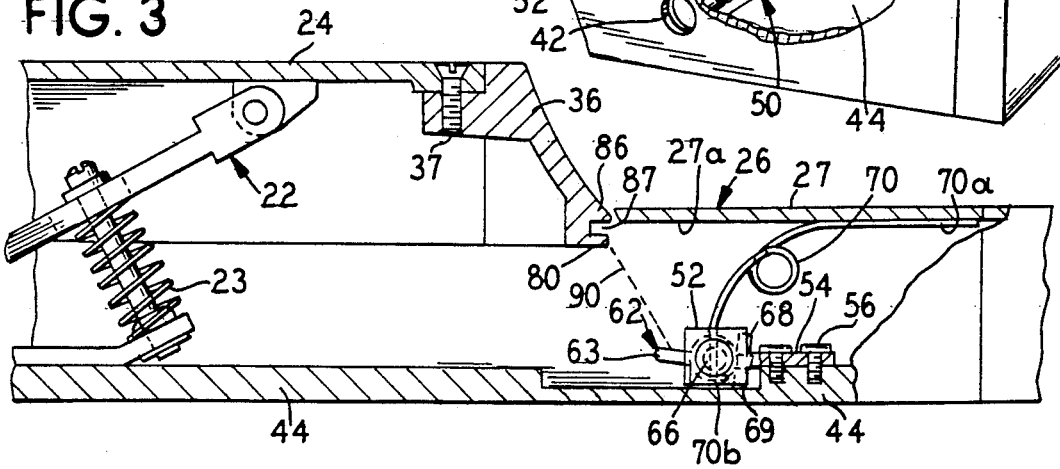
FIG. 4
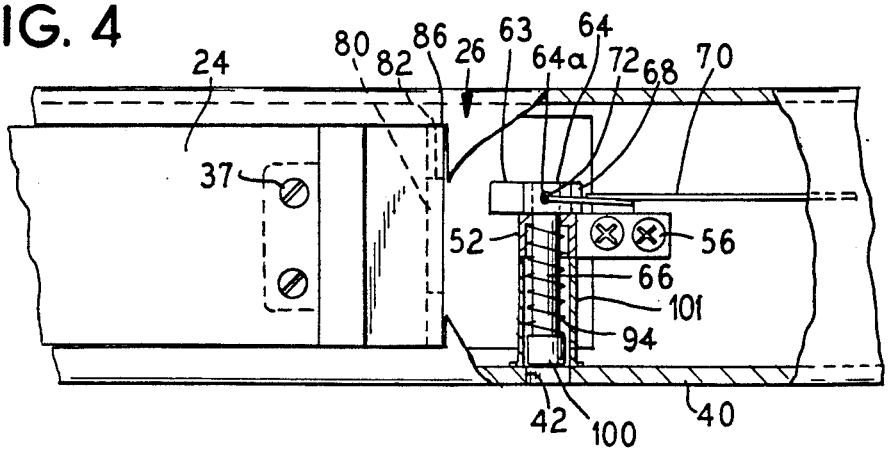

DOGGING DEVICE FOR PANIC EXIT DEVICE

BACKGROUND OF THE INVENTION

This invention relates to panic exit devices for securing or latching a door to a door frame while at the same time providing egress from those doors by pushing the panic exit device. More particularly, this invention relates to an apparatus for retaining the panic exit device in an unlatched condition to prevent wear and increase convenience during periods where the latching of the door upon closure is not desired.

Doors in high use passageways are often provided with latching mechanisms which upon closure of the doors latch the doors in a closed position. Each time the doors open the latch must be released and as a result, the locking or securing mechanisms for these doors can quickly wear out.

Many high use doors are equipped with locks operated by so-called panic bars or panic exit devices. These bars or devices are mounted on one face of the door and when pressed in the direction of the door cause the door to open in that direction. They are most often found in public buildings such as schools. Some of these devices are provided with dogging mechanisms to hold their latch bolts in an open position so that the latch mechanisms will not have to be operated each time the doors open. Custodial personnel can set the dogging mechanisms before business hours and then release them after business hours so that during the period the doors are used most, the latch mechanisms are not operated. Dogging mechanisms of this nature can be a set screw which when tightened bear against one of the operating parts of the lock and holds the latch bolt in the open position. Setting such dogging mechanisms is a time consuming procedure and requires a special tool to so activate.

The present invention is a dogging device which can be utilized with panic exit devices such as disclosed in U.S. Pat. No. 3,663,047 to Zawadzki, or U.S. Pat. No. 3,767,238 to Zawadzki, or U.S. Pat. No. 3,730,574 to Zawadzki, or U.S. Pat. No. 4,167,280 to Godec et al., or U.S. Pat. No. 4,389,988 to Betts et al.

Other prior art dogging devices include manual lock-type doggers as disclosed in U.S. Pat. No. 3,767,238 or U.S. Pat. No. 3,614,145, or set screw-type doggers such as disclosed in U.S. Pat. No. 3,854,763 or rotating levers which engage or disengage stop depending on angular position of rotation such as disclosed in U.S. Pat. No. 4,083,590 or U.S. Pat. No. 4,624,490, or U.S. Pat. No. 4,801,163. U.S. Pat. Nos. 3,873,141 and 3,945,670 disclose dogging means which can be controlled from a remote location, such dogging means operable electrically or pneumatically. These latter two patents disclose latching dogs having latching bosses which can protrude beneath vertically operable latching mechanicals to prevent downward retraction of the mechanicals, which prevents latching of the door.

SUMMARY OF THE INVENTION

The present invention relates to a panic exit device having a stationary base portion movably connecting a push bar portion, activating the push bar portion toward the base portion operates mechanicals residing therebetween to unlatch the door, and a dogging device mounted to the base portion to selectively engage with a ledge formed on an inward end of the push bar portion to releasably lock the push bar portion in an inwardly translated position with respect to the base portion. This locked position corresponds to an unlatched position of the panic exit device, particularly, retraction of a protruding door latch from out of a recess arranged in a door frame.

The dogging device comprises a tongue portion which is rotatably mounted to the base portion about an axis perpendicular to an a direction of approach of the ledge portion toward the dogging device. In an undogged condition, the ledge portion is arranged to impact the tongue and rotate the tongue harmlessly toward the base portion. The tongue portion is spring biased away from the base portion. The tongue portion is movable in an axial direction along its axis of rotation, and is biased by a second spring along its axis of rotation toward this undogged position.

To dog the push bar member in an inwardly advanced position toward the base portion, an activator button arranged along the axis of rotation of the tongue portion is depressed to translate the tongue portion inwardly along its axis to clear the approaching ledge portion of the push bar member. Once the ledge portion clears the path of the tongue portion in its approach towards the base portion, the tongue portion, under spring bias, translates back toward its original position, whereby the tongue portion can reside on a side of said ledge portion opposite said base portion, the "top side" of said ledge portion. Upon release of the activator button, the tongue portion, under spring bias by the second spring, returns to its original axial position but now on the top side of the ledge portion. The tongue portion further comprises a stop member to limit rotation of the tongue portion away from the base portion. Thus, the tongue portion residing on top of the ledge portion of the push bar member, captures the ledge portion, and prohibits retraction of the push bar member outwardly from the base member. Thus the panic exit device is dogged in the unlatched condition.

To release the dogging device the activating button is again depressed to translate the tongue portion along the ledge portion until the tongue portion clears the ledge portion whereas the ledge portion and the push bar member, under spring bias, departs away from the base portion to relatch the panic exit device.

This novel means of dogging a panic exit device provides an easily manufactured, easily and quickly engaged apparatus and method of dogging a panic exit device. No special tools are required to engage the dogging device. No keys that can be lost are required. A secure and sturdy means of dogging the panic exit device is provided.

BRIEF DESCRIPTION OF THE DRAWINGS

FIG. 1 is a perspective view of a panic exit device mounted to a door;

FIG. 2 is a perspective view of a dogging device mounted inside the panic exit device, with a portion of a cover removed for clarity;

FIG. 3 is a sectional drawing of an alternate embodiment of a panic exit device where the dogging device is offset from an approaching panic bar;

FIG. 4 is a top plan view of the panic exit device of FIG. 3 with a portion of the cover removed for clarity;

DETAILED DESCRIPTION OF THE PREFERRED EMBODIMENT

Figure 5:
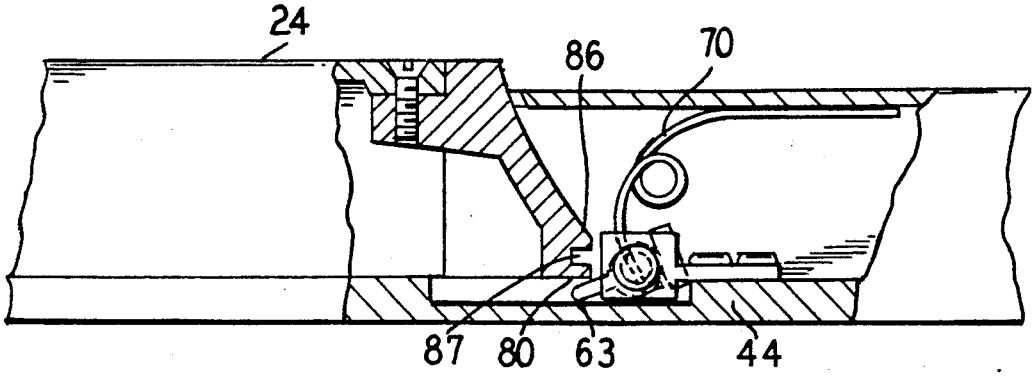
FIG. 5 is an elevation view of the panic exit device of FIG. 3 with a portion of a side wall removed for clarity, with the dogging device in an undogged position.

FIG. 1 shows a door 10 comprising an active stile 12 which swingingly engages a door frame, and a hinged stile 14, hinged pivotally to the door frame, in spaced apart parallel arrangement. Mounted between the door stiles 12, 14 is a panic exit device 20 comprising a push bar 24 resiliently mounted to a housing 26. By pushing the push bar 24 inwardly of the housing 26, a latch 30 retracts inwardly of the active door stile 12 to disengage the door 10 from a door frame (not shown). Inside the housing 26 resides the latching mechanicals partially shown at 22 in FIG. 3 which communicate with the latch 30. A first spring 23 biases the push bar 24 outwardly of the base plate 44 (shown in FIG. 3). Such an arrangement is known in the art.

FIGS. 2–4 show the push bar 24 having an end cap 36. The housing 26 comprises a cover 27 facing outwardly, and a side wall 40 facing downwardly, although the particular orientation of the side wall 40 is chosen arbitrarily downwardly. The side wall 40 could just as well be an upwardly facing side wall. The housing 26 also provides an aperture 42 through the side wall 40. The housing 26 also provides a base plate 44 on which is mounted a dogging device 50. The dogging device 50 comprises a journal 52 formed with a lug 54 which itself is screwed into the base plate 44 by screws 56. The journal 52 holds a shaft 66 rotatably therein which is axially aligned with the aperture 42. The shaft 66 is connected to a catch member 62 having a tongue 63, a boss portion 64, and a base portion 68 which provides an abutting face 69. A curled spring wire 70 at one end 70*a* presses against an inside surface 27*a* of the cover 27 and at an opposite end 70*b* is inserted through a passage or channel 64*a* provided through the boss portion 64 of the catch member 62. The spring wire 70 thus provides a rotationally biased position of the catch member 62 such that the tongue 63 will be biased toward the cover 27 and away from the base plate 44. From the boss portion 64 projects the tongue 63 which engages the end cap 36 to dog the panic exit device.

The end cap 36 provides a lip 86 extending across its width, and below the lip 86, formed in planar parallel fashion, is a ledge portion 80. The ledge portion 80 does not extend along an entire width of the end cap 36, the ledge portion 80 terminates in a first edge 82. The lip 86 and the ledge portion 80 form a channel 87 arranged along a partial width of the end cap 36.

The shaft 66 is mounted in fixed fashion to the boss 64 at a first end and provides a actuator button 100 at a second end. A second spring 94 is arranged around the shaft 66 and abuts the actuator button 100 and the journal 52. The shaft 66 extends through the journal 52 to connect with the boss 64. Thus, pushing the actuator button in an axial direction of the shaft 66, displaces, against the bias of the second spring 94, the shaft 66 and the catch member 62 inwardly from the side wall 40. The shaft 66, the second spring 94 and the actuator button reside within a sleeve 101 mounted to the side wall 40 and in communication with the aperture 42.

FIG. 5 shows the normal operation of the push bar 24 proceeding toward the base plate 44 to unlatch the door 10. The ledge portion 80 contacts the catch member 62, and as the push bar 24 proceeds further inwardly, rotates the catch member 62 toward the base plate 44 against the bias of the spring wire 70.

Figure 6:
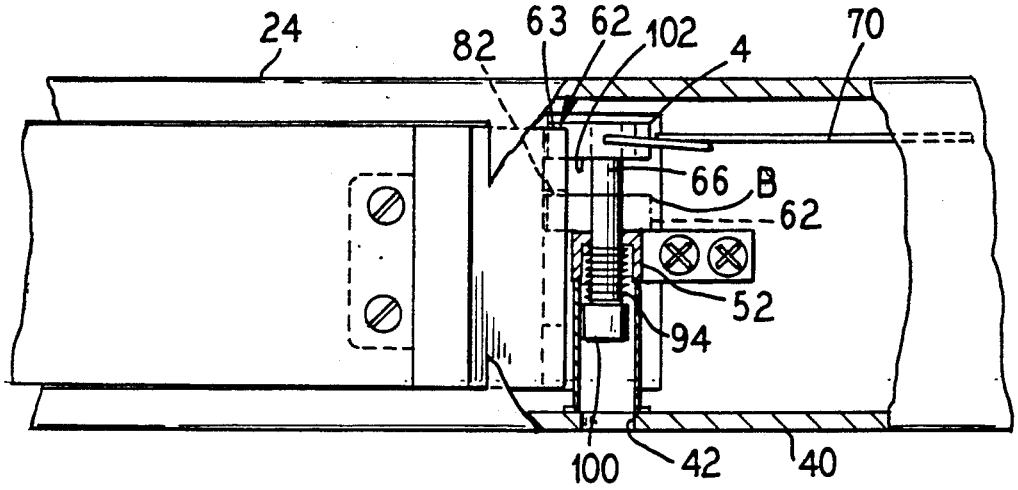
FIG. 6 is a top plan view of the panic exit device as shown in FIG. 5 with a portion of the cover removed for clarity.
Figure 7:
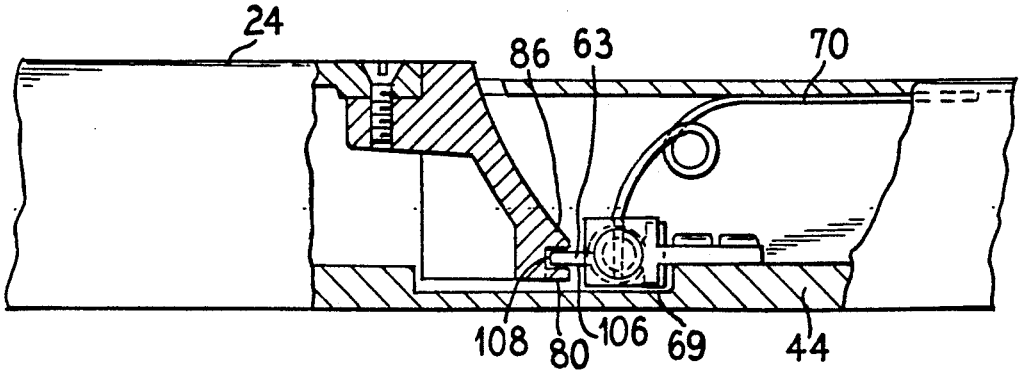
FIG. 7 is an elevation view of the panic exit device of FIG. 3 with the dogging device in a dogged position.

When it is desired to dog the push bar 24 in a locked position inwardly toward the base plate 44, as shown in FIG. 6 and FIG. 7, the actuator button 100 is depressed to relocate the catch member 62, and particularly the tongue 63, so that a trailing edge 102 of the tongue clears in axial direction the first edge 82 of the ledge portion 80. Once the trailing edge 102 has cleared the first edge 82, the tongue portion 63 will abut the lip 86 such as by springing back from its position as shown in FIG. 5, under the bias of the spring wire 70, to its position as shown in FIG. 3. Once the catch member 62 has reached this position indicated at A, the actuator button can be released. The second spring 94 will then return the shaft and thus the catch member to its original axial position toward the side wall 40. In this position, indicated as B, the tongue 63 will be captured between the lip 86 and the ledge portion 80 in the channel 87 as clearly shown in FIG. 7. The push bar 24, as shown in FIG. 7, cannot be retracted outwardly from the base 44 because rotation of the catch member 62 is prevented by abutment of the abutment surface 69 with the base plate 44.

To deactivate the dogging device, the actuator button 100 is again depressed to move the tongue 63 from its position B of FIG. 6 to its position A of FIG. 6. When the trailing edge 102 clears the first edge 82, the push bar 24 will be spring biased outwardly by the first spring 23, and will return to its natural outward position, causing the latch 30 to spring outwardly of the door 10.

It is to be noted that the thus described dogging device can be mounted at numerous positions around a periphery of the push bar 24, at either end of the push bar 24 or possibly at the upper and lower sides of the push bar 24. It is also to be noted that in the particularly described embodiment, the push bar 24 approaches the base plate 44 in a swinging, or oblique fashion as indicated by dashed line 90, shown in FIG. 3. However, the present invention is equally applicable to panic exit devices wherein the push bar 24 approaches the base plate 44 in perpendicular path fashion. This perpendicular path fashion is embodied in FIG. 2.

Although the present invention has been described with reference to a specific embodiment, those of skill in the art will recognize that changes may be made thereto without departing from the scope and spirit of the invention as set forth in the appended claims.

I claim as my invention:

1. A dogging arrangement for holding a panic exit device in an unlatched condition, the panic exit device having a push bar resiliently mounted to a base, and having mechanical means communicating to an external latch to unlatch a door from a door frame when said push bar is translated toward said base, comprising:

a ledge portion mounted to said push bar movable toward said base, said ledge portion having a first side toward said base and a second side away from said base;

a dogging device mounted to said base having:

a tongue aligned fronting said first side of said approaching ledge portion in a first axial position of said tongue, a shaft mounted to said tongue at a first end of said shaft and providing an actuator button at a second end, a journal portion mounted to said base and holding said shaft to said base and allowing movement of said shaft along an axis of said shaft, said tongue mounted for rotational movement about the axis of said shaft, said tongue and said shaft arranged such that axial translation of said actuator button translates said tongue to a second axial position clearing said tongue from alignment with said approaching ledge portion wherein said tongue can thereafter be rotated to a first rotational position, about the axis of said shaft, passing said second side of said ledge portion opposite said base, wherein said tongue and said shaft can thereupon be axially retracted by releasing said actuator button, whereupon said tongue retains a position fronting and abutting said second side of said ledge portion, and a means for limiting rotation of said tongue about said shaft away from said base, to thus capture said ledge portion between said tongue and said base and hold said push bar in an inward position toward said base.

2. A dogging arrangement according to claim 1, wherein said push bar comprises a lip arranged planarly parallel to said ledge portion and facing said second side of said ledge portion, said lip and said ledge portion defining a channel therebetween, and said tongue captured inside said channel when said tongue is axially retracted fronting said second side of said ledge portion.

3. A dogging arrangement according to claim 1, wherein said dogging device further comprises a means for rotationally biasing said tongue to said first rotational position, and said means for limiting rotation of said tongue prevents rotation past said first rotational position.

4. A dogging arrangement according to claim 3, wherein when said panic exit device is in an undogged condition and said panic bar is translated toward said base, said ledge portion abuts said tongue on said first side of said ledge portion and rotates said tongue toward said base against the urging of said means for rotationally biasing.

5. A dogging arrangement according to claim 4, wherein said panic exit device comprises a housing mounted to said base, and said push bar is translated toward said base and into said housing, and said means for rotationally biasing comprises a curled spring wire mounted at a first end to said tongue and pressing at a second end against an inside surface of said housing.

6. A dogging arrangement according to claim 5, wherein said dogging device comprises a boss portion connecting said tongue and said shaft, said boss portion rotatable with said tongue about the axis of said shaft and said spring wire penetrates said boss at said first end of said spring wire, penetrating in a direction perpendicular to the axis of said shaft.

7. A dogging arrangement according to claim !, wherein said dogging device further comprises a means for axially biasing said tongue toward said first axial position.

8. A dogging arrangement according to claim 7, wherein said means for axially biasing comprises a coiled spring surrounding said shaft and fit between said journal and said actuator button, and said panic exit device further comprises a housing mounted to said base and surrounding said dogging device, said housing providing an aperture for communicating with said activator button residing recessed inside said housing, translation of said actuator button inwardly of said housing moves said tongue from said first position to said second position.

9. A dogging arrangement according to claim 1, wherein said means for limiting rotation comprises a bar mounted to said tongue, said bar rotating about the axis of rotation of said tongue, said bar abutting said base when said tongue is rotated to said first rotational position preventing further rotation of said tongue.

10. A dogging arrangement according to claim 1, wherein said journal comprises a lug portion which is fixed to said base using removable fasteners.

11. In a panic exit device having two members capable of relative movement toward one another to a close position and away from one another to a distant position with mechanical means operably connected to one of said members to retract a latch bolt upon said members moving to said close position, a dogging device for selectively holding said two members in said close position comprising:

a dogging piece with a projection extending therefrom, means for mounting said dogging piece on a first of said members in a manner such that said piece is slidable along an axis perpendicular to said relative movement between said two members, between a first and second axial position, and rotatable about said axis between a first and second rotational position;

detent means for selectively capturing said projection, said detent means being fixedly mounted to a second of said members;

means for retainingly engaging said projection with said detent by moving said members to said close position, moving said piece axially from said first axial position to said second axial position, rotating said piece at said second axial position from said first rotational position to said second rotational position and returning said piece to said first axial position while said members are in said close position whereupon said projection will be in engagement with said detent means and wherein said first and second members will be retained in said close position.

12. A dogging device according to claim 11 comprising a means for biasing said dogging piece into said first axial position.

13. A dogging device according to claim 11 comprising means for biasing said dogging piece into said second rotational position.

14. A dogging device according to claim 11, wherein said means for mounting said dogging piece comprises a journal mounted on one of said members.

15. A dogging device according to claim 11, wherein said detent means comprises a channel with side walls for capturing said projection therebetween and said means for retainingly engaging includes an opening in one of said side walls permitting said projection to be rotated into said channel when said piece is in said second axial position.

16. A dogging device according to claim 11, wherein said two members comprise a base plate and a movable bar, and said dogging piece is mounted on said base plate.

17. A dogging device according to claim 11, wherein said means for retainingly engaging comprises means for preventing rotation of said dogging piece beyond said second rotational position.

18. A dogging device according to claim 11, wherein said means for mounting said dogging piece comprises means for biasing said dogging piece into said first axial position and means for biasing said dogging piece into said second rotational position.

19. A dogging device according to claim 18, wherein when said members are moved from the distant position to the close position, with the dogging piece in said first axial position, said second of said members abuts and rotates said dogging piece from said second rotational position to said first rotational position.

20. A dogging device according to claim 19, wherein said means for retainingly engaging said projection comprises means for preventing rotation of said dogging piece beyond said second rotational position.

* * * * *

UNITED STATES PATENT AND TRADEMARK OFFICE

CERTIFICATE OF CORRECTION

PATENT NO. : 5,016,927

DATED : May 21, 1991

INVENTOR(S) : George Toledo

It is certified that error appears in the above—identified patent and that said Letters Patent is hereby corrected as shown below:

At column 5, line 61, please change "!" to --1--.

Signed and Sealed this

Tenth Day of December, 1991

*Attest:*

HARRY F. MANBECK, JR.

*Attesting Officer*

*Commissioner of Patents and Trademarks*